US005628162A

United States Patent [19]

Kreusch et al.

[11] Patent Number: 5,628,162

[45] Date of Patent: May 13, 1997

[54] PLANT FOR MAKING AND PACKAGING CIGARETTES

[75] Inventors: Christian Kreusch; Peter Riedelbauch, both of Berlin; Peter Kauffmann, Dogern; Carsten Becker, Hamburg, all of Germany

[73] Assignee: British-American Tobacco (Germany) GmbH, Hamburg, Germany

[21] Appl. No.: 387,467

[22] Filed: Feb. 13, 1995

[30] Foreign Application Priority Data

Feb. 16, 1994 [DE] Germany ..... 44 04 929.3

[51] Int. Cl.[6] ..... B65B 19/02

[52] U.S. Cl. ..... 53/168; 53/148; 53/154; 53/167; 53/202; 131/283; 198/347.1; 198/349; 198/358; 414/222

[58] Field of Search ..... 131/283; 104/88.01, 104/88.02, 88.03; 180/168; 414/222, 416; 364/478; 198/358, 347.1, 349, 349.6, 349.7; 53/167, 168, 148, 154, 202

[56] References Cited

U.S. PATENT DOCUMENTS

| | | | |
|---|---|---|---|
| 3,665,933 | 5/1972 | Molins et al. | 131/203 |
| 3,726,383 | 4/1973 | Bornfleth et al. | 198/358 |
| 3,777,911 | 12/1973 | Bornfleth | 414/222 |
| 3,820,671 | 6/1974 | Schubert et al. | 414/222 |
| 3,967,740 | 7/1976 | Molins | 53/148 X |
| 4,008,555 | 2/1977 | Ainoya et al. | 53/148 |
| 4,053,741 | 10/1977 | Ainoya et al. | 364/478 |
| 4,085,759 | 4/1978 | Seragnoli | 53/148 X |
| 4,181,212 | 1/1980 | Hinchcliffe | 53/148 X |
| 4,373,624 | 2/1983 | Molins et al. | 198/358 X |
| 4,565,203 | 1/1986 | Stewart et al. | 131/283 |
| 4,696,617 | 9/1987 | Kumata et al. | 414/416 X |
| 4,892,453 | 1/1990 | Bantien et al. | 414/222 X |
| 4,903,713 | 2/1990 | Clarke | 131/283 |
| 5,190,428 | 3/1993 | Bryant et al. | 104/88.02 X |

FOREIGN PATENT DOCUMENTS 2718125 4/1977 Germany .

*Primary Examiner*—Daniel Moon

*Attorney, Agent, or Firm*—Armstrong, Westerman, Hattori, McLeland & Naughton

[57] ABSTRACT

In a plant for making and packaging cigarettes, comprising a plurality of cigarette-making machines and a plurality of machines for packaging cigarettes in packs, the makers and packers are combined in a number of modules. The output sides of the modules comprising makers and the input sides of the modules comprising packers are arranged in side-by-side relationship and face a central transport track on which driverless, remotely controlled transport vehicles circulate in one direction. Furthermore, there is provided at least one store which is situated at the transport system with at least an input and an output side and which serves as a buffer between the makers and the packers. The transport system is completely isolated from other transport systems with which packaging materials are supplied to the various modules.

17 Claims, 3 Drawing Sheets

PLANT FOR MAKING AND PACKAGING CIGARETTES

BACKGROUND OF THE INVENTION

1. Field of the Invention

The invention relates to a plant for making and packaging cigarettes, comprising a plurality of cigarette-making machines (makers), a plurality of machines for packaging cigarettes (packers), at least in packs, if necessary in cartons and boxes, a first transport system for the transport of the manufacturing materials to the cigarette-making machines and packaging machines, and a second transport system for the transport of cigarettes in containers from the cigarette-making machines to the packaging machines or from the cigarette-making machines via an intermediate store to the packaging machines.

For the sake of simplicity, the cigarette-making machines are called hereinafter "makers" and the various types of cigarette-packaging machines are called "packers".

2. Description of the Prior Art

Systems described in, for example, Applicant's German Offenlegungsschrift 40 18 266.5 are known. In those systems, each maker which produces the cigarettes from the manufacturing materials supplied, i. e., the tobacco blend, the cigarette paper, and, as the case may be, the filter material, is associated with a particular packer line which packages the cigarettes arriving from the maker in packs, the same in cartons, and the latter in boxes. If making and packaging only one particular type of cigarette in a particular pack are of interest, such systems are quite suitable. But in the cigarette-making industry there is a trend to offer the greatest possible number of types of cigarettes. For example, for one brand of cigarettes there exist seven different types of cigarettes (length, imprint, lights blend, etc.) which must be packaged for various countries in about 80 different versions of packs. It is not possible to operate for this purpose 7 different makers and 80 different packers in side-by-side relationship. At least some of the resulting 80 production units would not be used to capacity since only relatively small quantities of some of the versions in certain packs will have to be produced; on the other hand, the unit composed of maker and packer would often not be adequate for other cigarettes and packs produced on a larger scale so that a plurality of such units would have to be operated in side-by-side relationship for that purpose.

In order to produce such a variety of versions one must either frequently refit existing production and packaging lines, which means extended down times of the system, or make use of the possibility of storing the cigarettes produced by the maker in so-called storage shelves, to collect these shelves, and to keep them in intermediate storage or to transport them immediately to the packer. This procedure is very costly and prone to failure. In addition, this procedure is very labour intensive.

SUMMARY OF THE INVENTION

In order to overcome the cited difficulties inter alia, the invention specifically solves the problem of configuring a production system according to the preamble of claim 1 in such a way that it cannot only be easily operated automatically but that it is also highly adaptable, i.e., that it can be switched from one type of cigarette to another and from one type of pack to another. Nevertheless, the system according to the invention is to facilitate simultaneous production of lots of various cigarettes of various dimensions in different packagings.

Adaptability of the production units also means that machines of various capacity classes (fast running and slower machines) can be integrated into that system.

The invention solves the above-discussed problem of the known system.

There the cigarettes can either be inserted into the containers proper by the container-filling and container-handling stations or first be put into storage shelves which are then inserted into the containers.

On this occasion, the vehicles circulating in one direction on the transport path of the second transport system are loaded with containers filled with finished cigarettes from each maker of each of the maker modules—more precisely from the respective container-filling and container-handling stations. These containers are either supplied to the intermediate store or directly to the packer designated for the cigarettes from the respective maker, as required. The vehicles of the second transport system then return into the circulation in order to collect once more a completed container from the same maker or from another maker and to transfer it into the store or to the packer. Empty containers are transported from the packer to the store or to the maker.

The system can be operated by computer control practically fully automatically, except for the required service personnel. In principle, no operators are required. The entire transport operation, like the production and packaging operations, can be fully automated; the containers dispensed from each of the makers can be provided with electronic identification means and fed into the store. They can be recalled from the store and transferred to the packer for the respective cigarette brand. All the operations, storekeeping included, can be computer controlled.

Since the first and second transport systems, i.e., the transport system for feeding production materials to the various maker and packer modules, are completely separated from the transport system for transporting the cigarette-filled containers (if necessary via the detour through the store) to the associated packer, all the maker and packer modules can be situated on the second transport system as the tines on a comb are situated on the back of the same.

All the modules have preferably approximately the same size. This does not only facilitate the construction of the second transport system but is also advantageous for replacing the elements of a module by the elements of some other module. For example, a packer module can be readily exchanged against a maker module and vice versa.

Accordingly, it is also preferred that the intermediate store, or each intermediate store, require only the space of one module or of a plurality of modules.

In order to make the system as compact as possible, the module and intermediate stores are preferably arranged on both sides of the second transport system's tracks which are arranged in side-by-side relationship along a straight line so that each module is faced by an other module or by an intermediate store, to the extent to which this is feasible. In this way one can do with a relatively short transport system.

By the very principle, as an alternative all of the modules can be arranged only on one side of the straight path of the second transport system. In practice, the latter arrangement will be adopted only when the number of modules is small, for example, when only one module with a small number of makers and packers is situated on each of the two sides of an intermediate store.

In a preferred embodiment of the invention, a store is located on one side of the side-by-side tracks of the second transport system between modules with makers and modules with packers are located on the other side. This makes a very compact arrangement possible.

The tracks of the second transport system preferably run on all sides around the intermediate store or each of the intermediate stores. In this way at the same time the intermediate store can be supplied with containers and emptied out of containers from two sides.

In order to have at all times sufficient transport vehicles available for the vehicle requirements defined by the timing cycle of the system, one preferably provides a track loop as a parking track for vehicles. This loop can be situated, for example, at the end of the row of modules on one side of the tracks or on the store's (or of each store's) side facing the side-by-side tracks.

In order to avoid waiting times (which might develop when a transport vehicle has to wait for loading or unloading of the preceding vehicle), the side-by-side tracks are conveniently configured in quadruplicate and appropriate shunts and passages are provided so that a vehicle can change the track and can overtake.

The modules with packers are preferably provided with unit-packaging devices, particularly for packing cartons, which devices can be connected to the packers.

According to another preferred embodiment of the invention, there is provided at least one more module for packaging the packs or lots prepared by the modules with packers into larger lots or boxes.

This module is advantageously supplied with cigarette packs or lots from conveyor belts which are situated on the packer modules' sides far from the side-by-side tracks.

Naturally, care must be taken lest these conveyor belts collide with the first transport system. For this reason, the conveyor belts may be arranged on an appropriate level.

The container-filling and container-handling stations preferably fill the cigarettes into shelves, slide them into transport containers, and set the latter on vehicles of the second transport system.

The design of the intermediate store becomes particularly simple and its usability particularly great if it is configured as a so-called random store with electronically controlled filling and retrieval. In this way each free storage position can be used. Since the controlling computer knows exactly what is located at any storage position of the intermediate store, upon receiving a request signal for a container with cigarettes from a specific maker, it can immediately release the container for transfer to the respective packer, irrespective of the storage position of this container.

The intermediate store or stores are preferably upright shelf stores.

In the invention the containers are advantageously set onto the transport vehicles in such a way that the direction of travel coincides with the longitudinal direction of the cigarettes inside the container, namely so that the cigarettes bear on the shelf wall or the container partition in the direction of travel. In this way the latter are handled gently. In addition, in this way a relatively slim transport vehicle can be used. In order to ensure safe transport of the cigarettes inside the containers on the transport system, the containers are inclined under an angle of say 10° relative to the direction of travel.

If the shelves were inclined inside the containers, the interior of the containers would not be optimally used.

In regard to the advantages of the invention, it is also noted that an existing production system need not necessarily be converted in a single step into a system according to the invention. The invention rather makes it possible to carry out such a conversion in steps.

As far as the invention is concerned, the number of packers is conveniently equal to the number of makers in many cases, as in the embodiments illustrated. But this is not absolutely necessary. Further, one can employ, for example, cigarette-making machines of different outputs, i.e., a very fast, a medium-fast, and a slow maker to meet the respective requirements.

BRIEF DESCRIPTION OF THE DRAWINGS

Advantageous embodiments of the invention are described below as explanatory examples with reference to the appended drawwings. In these drawings

DETAILED DESCRIPTION OF PREFERRED EMBODIMENTS

Figure 1:
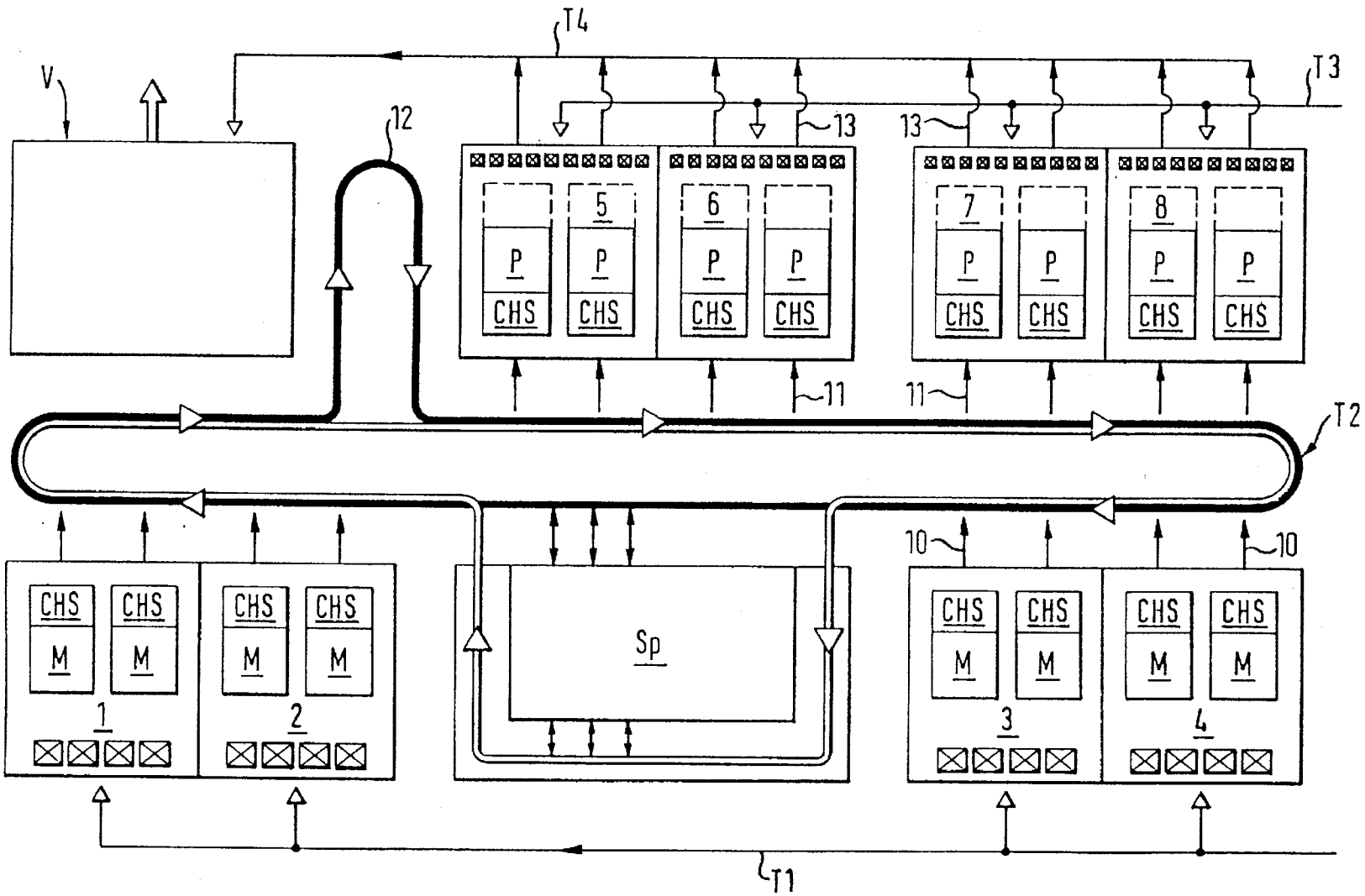
FIG. 1 shows in a highly schematised representation the ground plan of a system according to the invention comprising four maker modules and four packer modules.

The system illustrated in FIG. 1 comprises four maker modules 1, 2, 3 and 4, arranged in side-by-side relationship, with the two modules 1 and 2, as well as 3 and 4, arranged in direct side-by-side relationship. There is a gap between these two groups of modules and this gap is as wide as two modules and occupied by a store Sp. Each of the maker modules 1 to 4 comprises two cigarette-making machines or makers M, each of which is followed by a container-filling and container-handling station CHS. The direction of operational flow of the various makers M is from below to the top in FIG. 1.

Accordingly, in FIG. 1 underneath the maker modules which are arranged in a row there is provided a first transport system T1 which supplies manufacturing materials such as cigarette paper, if necessary filter material and cover paper, to the modules or, more precisely, to the makers M arranged in these modules 1 to 4. The transport system T1 can work fully automatically and is controlled by the computer which controls the entire system. Each of the modules can retrieve via this transport system the required manufacturing materials which are delivered only on one side of the row of maker modules 1 to 4, are kept there in intermediate storage on schematically indicated storage positions, and are fed automatically or manually to the makers M, as required.

As indicated above, the operational flow of these materials through the maker M is from below to the top in FIG. 1, i.e., on the horizontal plane from one side of the modules 1 to 4 or of the makers M to the other side. Accordingly the finished cigarettes are filled into containers 15 at the container-filling and container-handling stations CHS (see FIG. 3). These containers are delivered for further processing onto a second transport system T2, as indicated by arrows 10, in the upper part of FIG. 1. Thus, the stations CHS and the second transport system T2 are located on the modules' 1 to 4 and maker's M side far from the transport system T1.

After storage in the store Sp, the containers 15 with the cigarettes can be transferred to the four packer modules 5 to 8. As indicated by arrows 11, they are put into them by means of the container-emptying and container-handling stations CHS. The operational flow of the materials is again from below to the top, i.e., from the packer modules' 5 to 8 side facing the second transport system T2 to the other side.

From the common upper straight front line of the four maker modules 1 to 4 in FIG. 1 there extends the second transport system T2 which comprises at least two parallel tracks, but preferably four tracks, so that the driverless, electronically controlled transport vehicles (not shown in the figure) of the transport system T2 are not only guided in one direction in a circulation (as indicated in the drawing) but may also overtake each other.

The transport vehicles are preferably equipped with flexible laser steering means so that no tracks need be laid out in the floor. Also the overtaking of the vehicles is not restricted to shunts between the tracks but may occur everywhere.

As can be inferred from FIG. 1, the transport system T2 runs in a loop around the store Sp so that—as indicated by double arrows in the drawing—transport containers 15 can be run into the store at several points on both sides of the store or can be removed from the same.

To the left of the last packer module 5 of this row there is provided an other loop 12 of the second transport system, which loop serves as a standby loop for transport vehicles which are not needed.

As indicated by arrows 11, the packer modules 5 to 8 are supplied from below by the transport system T2 with containers 15 containing finished cigarettes, as shown in FIG. 1. The various packers P of these modules are again preceded by container-handling and container-emptying stations CHS which feed cigarettes to the packers P but also return the emptied containers to the transport system T2 where they can be picked up by transport vehicles designated for that purpose and used for future transport of cigarettes.

The packers P of the packer modules 5 to 8, in which the flow of material is from the bottom upwards as in the makers of FIG. 1, are supplied with the manufacturing materials such as paper, boxes, transparent foil and the like, via the transport system T3 which can be combined with transport system T1 to form a single unit. The finished cigarettes, which are packaged into, for example, packs or cartons or boxes in the packers P, are transferred, as indicated by the arrows 13, to the transport system T4 which is separated from the transport system T2 like transport system T3 and feeds the cigarette lots supplied by the packers P via conveyor belts to, for example, a packer V for shipping boxes, where the lots are automatically packaged into boxes for shipping. The finished, boxed cigarettes are dispatched directly from the packer of shipping boxes or are transferred into an intermediate store.

The second transport system T2 extends basically between the row of maker modules, on the one hand, and the row of the packer modules, on the other, whereas transport systems T1 and T3 are located on the row of packer modules' 5 to 8 and maker modules' 1 to 4 sides far from the second transport system T2.

The system works as follows: All transport vehicles, which are not parked in the standby loop, circulate continuously in the transport system T2. When the container-filling and container-handling station of a maker M of one of the modules 1 to 4 requests a vehicle for retrieving a container with finished cigarettes, a transport vehicle stops before the respective station CHS, first delivers an empty container 15, is then loaded with the container 15, travels with the filled container to the store Sp, and, for the time being, stores the container 15 there. This store is a so-called random store, i.e., the container can be put into the intermediate storage at any unoccupied storage position. Since the type of the container contents, e.g. long filter cigarettes, is recorded as soon as there is a demand at the respective packer, the computer controlling the system can recall the container and transfer it to the corresponding packer P by means of the transport system T2. Of course, it is not necessary that a certain packer P is associated with each of the makers M. It is well possible that the cigarettes produced by one maker M are distributed among two different packers P or that, possibly, one packer P serves simultaneously two different makers M. The setting is adjusted from case to case since the purpose of the system ist, inter alia, to facilitate simultaneous production of various types of cigarettes and their packaging in a large number of different packs.

Figure 2:
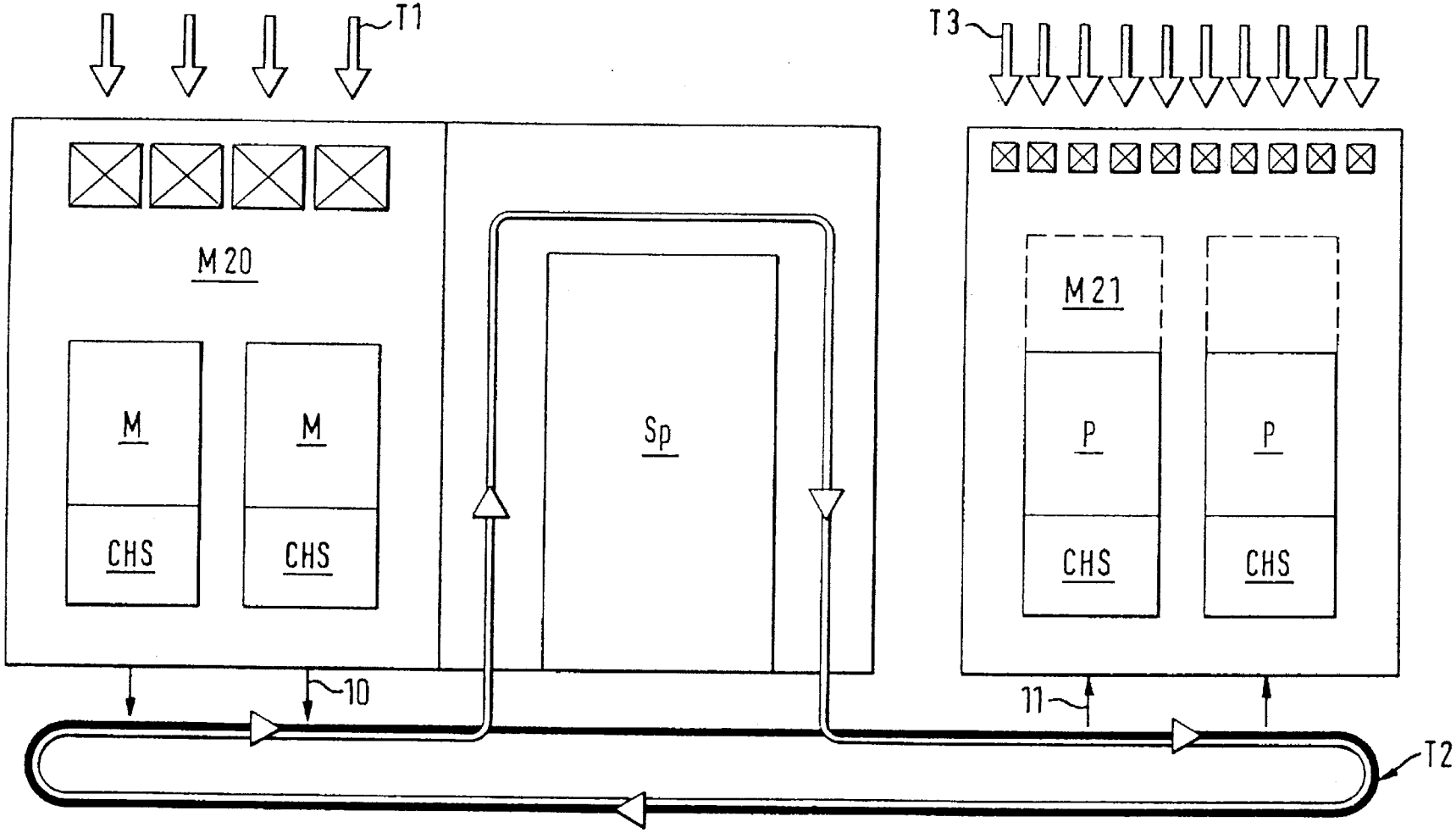
FIG. 2, shows the ground plan of a small system according to the invention comprising one maker module and one packer module with an intermediate store.

The system according to the invention, illustrated in FIG. 1, is obviously a relatively large system. The invention can be practised even in a substantially smaller system, as illustrated by FIG. 2. In the system shown in FIG. 2, similar reference symbols denote similar elements. Accordingly, also this system comprises a second transport system T2 in which driverless transport vehicles (not illustrated) circulate in one direction on two conveying tracks arranged in side-by-side relationship. Here the conveying paths conveniently comprise three tracks since overtaking is not possible on the lower track.

A first module M20 comprising two makers M and two subsequent container-filling and container-handling stations CHS faces with its output side the transport system T2. Accordingly, the input side of the module M21, which comprises two container-retrieving and container-handling stations CHS and two packers P, faces the transport system T2. Between the two modules M20 and M21 there is the store Sp which has the same size as the two equally large modules M20 and M21.

The manufacturing materials are supplied, as shown in FIG. 2, from above via the transport systems T1 and T3, i.e., of the modules' M20 and M21 side far from the transport system. The transport system T1 and T3 are conveniently combined into one transport system which supplies manufacturing materials to the maker and packer modules M20 and M21.

The important distinction of this plant from that shown in FIG. 1 resides in the fact that not only is the plant significantly smaller but, because of this small size, the two modules M20 and M21 and the store Sp are located on only one side of the transport system T2. Both functions and operation of the entire plant are basically similar to those of the plant according to FIG. 1. Here the cigaarettes packaged into lots by the packers P are removed on the upper side of the figure, i.e., where the transport system T3 supplies the manufacturing materials, and are transferred to another packer, a warehouse or the customer. This can be effected via conveyor belts mounted on an appropriate level.

Figure 3:
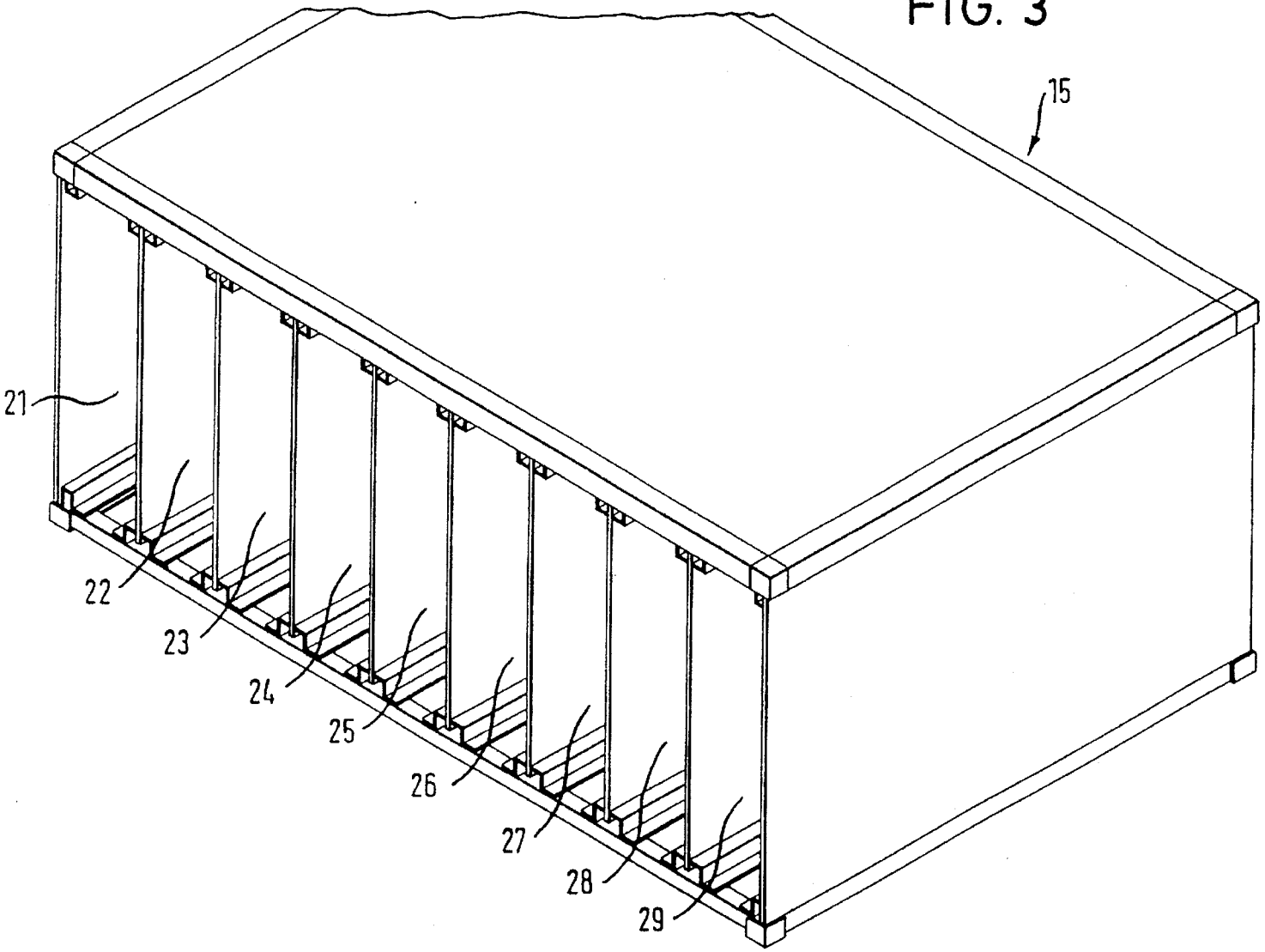
FIG. 3, shows in perspective view a container of the type which can be used in accordance with the invention.

In the invention, the cigarettes are advantageously transported with the aid of containers 15, one of which is shown in FIG. 3. This container 15 is basically a box closed on all sides, which need be open only on the side provided with the openings 21 to 29. It can be, for example, a modern light-weight structure of aluminium.

In a manner not shown, the container is advantageously provided on the upper side and the bottom side with complementing studs and recesses serving to align two containers.

The container 15 has nine accomodating compartments, each of which has one of the openings 21 to 29 on one side.

A shelf with cigarettes can be slid into each of these accomodating compartments from the respective opening. The shelf is in the vertical position and is free of float, if possible. Handling cigarettes in the transport from the makers M to the packers P or to the store and from the same to the packers is greatly facilitated by such transport containers 15 because it is no longer necessary to transport and handle individual shelves. Depending upon the prevailing conditions, a plurality of such containers 15 in stacked arrangement could be transported with each of the transport vehicles of the transport system.

Even better use would be made of space if the cigarettes were stored without the shelves in the accomodating compartments of the container 15. In this case the width of each accomodating compartment must match the length of the cigarettes.

The entire plant in the form described can be readily operated under control by a central computer; in addition, it facilitates the transition from one type of cigarette to another and from one form of packaging to an other and various combinations of types and packagings.

We claim:

1. A plant for making and packaging cigarettes, comprising:

a plurality of cigarette-making machines;

a plurality of packaging machines for packaging cigarettes in at least one of packs, cartons and boxes;

a first transport means for transporting manufacturing materials to the cigarette-making machines and packaging machines;

a second transport means for transporting cigarettes in containers from one of: (i) the cigarette-making machines to the packaging machines, and (ii) the cigarette-making machines through an intermediate store to the packaging machines;

a container-filling and container-handling station located downstream of each of the cigarette-making machines, wherein the cigarette-making machines with the downstream stations are combined to form at least one side-by side module with identical direction of materials flow with the downstream stations situated at the second transport system; and a container-handling and container-emptying station arranged upstream from each of the packaging machines, wherein the packaging machines with the upstream stations are combined to form at least one side-by-side module with identical direction of materials flow with the upstream stations situated at the second transport system, wherein at least one intermediate store for the containers is situated at the second transport system, wherein the second transport system comprises driverless, floor-bound vehicles for transporting containers which are circulated in one direction on at least two tracks arranged in side-by-side relationship, and wherein the first transport system extends on all modules' side far from the second transport system.

2. The plant according to claim 1, wherein all modules have substantially the same size.

3. The plant according to claim 1, wherein a face of each of the intermediate stores is one of: (a) equal to an area of at least a module, and (b) a multiple of the area of at least the module.

4. The plant according to claim 1, wherein the modules and the intermediate stores are distributed over both sides of the tracks situated in side-by-side relationship along a straight line.

5. The plant according to claim 3, wherein on one side of the side-by-side tracks of the second transport system there is situated a store between at least two modules with cigarette-making machines and, on the other side, at least two modules with machines for packaging cigarettes, and wherein the store faces at least one module on the other side of the tracks.

6. The plant according to claim 3, wherein at least one module with cigarette-making machines and at least one module with packaging machines are situated on one side of the second transport system and a store is provided between the two modules.

7. The plant according to claim 1, wherein each of the intermediate stores is surrounded on all sides by tracks.

8. The plant according to claim 1, wherein a loop of the track is provided as a parking track for vehicles.

9. The plant according to claim 1, wherein four tracks of said second transport means are in side-by-side relationship to thereby facilitate overtaking travel.

10. The plant according to claim 1, wherein the containers are transported inclined at an angle of 10° relative to the direction of travel.

11. The plant according to claim 1, wherein the modules having machines for packaging cigarettes also comprise boxing machines connected to packs-packaging machines.

12. The plant according to claim 1, further comprising at least one other module with a shipping-box packer for packaging packs or lots made in the modules having machines for packaging cigarettes into larger lots or boxes.

13. The plant according to claim 12, wherein the additional module is supplied via conveyor belts situated on the side far from the side-by-side tracks of the modules having machines for packaging cigarettes or via conveyor belts mounted on an appropriate level.

14. The plant according to claim 1, wherein the container-filling and container-handling stations fill the cigarettes into shelves, put the cigarettes into accommodating compartments of transport containers, and set the cigarettes onto vehicles of the second transport system.

15. The plant according to claim 1, wherein each container accommodates the cigarettes in compartments without shelves.

16. The plant according to claim 1, wherein each of the intermediate stores is a random store with electronically controlled filling and retrieval.

17. The plant according to claim 16, wherein each of the intermediate stores is an upright shelf store.

* * * * *